US008307609B2

(12) United States Patent
Kim

(10) Patent No.: US 8,307,609 B2
(45) Date of Patent: Nov. 13, 2012

(54) REINFORCEMENT DEVICE FOR LATERAL BUCKLING STRESS AND METHOD OF ENGAGING REINFORCEMENT DEVICE

(75) Inventor: Kang Sik Kim, Daejeon (KR)

(73) Assignee: Korea Electric Power Corporation, Seoul (KR)

( * ) Notice: Subject to any disclaimer, the term of this patent is extended or adjusted under 35 U.S.C. 154(b) by 149 days.

(21) Appl. No.: 12/752,334

(22) Filed: Apr. 1, 2010

(65) Prior Publication Data

US 2011/0239585 A1 Oct. 6, 2011

(51) Int. Cl.
*E04C 3/00* (2006.01)

(52) U.S. Cl. ..... 52/843; 52/844; 52/846; 52/834; 52/223.14; 52/291; 248/228.1; 248/226.11

(58) Field of Classification Search ..... 52/835, 52/222, 223.3, 170, 834, 832, 845, 844, 848, 52/849, 836, 223.8, 223.14, 223.4, 231, 291, 52/843, 846; 248/220.21, 226.11, 228.1, 248/228.6, 228.4, 219.3, 219.4
See application file for complete search history.

(56) References Cited

U.S. PATENT DOCUMENTS 2,087,768 A * 7/1937 Forbes et al. ..... 148/546
4,038,802 A * 8/1977 Bajorek et al. ..... 52/832
4,071,996 A * 2/1978 Muto et al. ..... 52/745.21
4,455,112 A * 6/1984 Anders ..... 406/110
4,725,463 A * 2/1988 Baumber et al. ..... 428/33
4,837,885 A * 6/1989 Yang ..... 14/21
5,006,386 A * 4/1991 Menichini ..... 428/58
5,924,655 A * 7/1999 Rinderer ..... 248/55
5,974,744 A * 11/1999 Guilbeault ..... 52/170
6,076,316 A * 6/2000 Cormann ..... 52/220.1
6,148,585 A * 11/2000 Baker ..... 52/834
6,354,682 B1 * 3/2002 Nott et al. ..... 312/248
6,357,842 B1 * 3/2002 Nott et al. ..... 312/248
6,454,232 B1 * 9/2002 Roth ..... 248/228.1
6,550,878 B2 * 4/2003 Nott et al. ..... 312/248
6,915,616 B2 * 7/2005 Fontana et al. ..... 52/844
7,284,728 B2 * 10/2007 Connolly ..... 248/62
7,464,512 B1 * 12/2008 Perina ..... 52/651.01
7,748,307 B2 * 7/2010 Hallissy et al. ..... 89/36.04
8,061,096 B2 * 11/2011 Kim et al. ..... 52/291
2003/0213152 A1 * 11/2003 Kim ..... 40/607.14

* cited by examiner

*Primary Examiner* — William Gilbert
*Assistant Examiner* — Chi Q Nguyen
(74) *Attorney, Agent, or Firm* — McDermott Will & Emery LLP

(57) ABSTRACT

A reinforcement device for a lateral buckling stress installed on an angle-type steel member so as to be attachable and detachable therefrom without power-off of a power line tower, preparation and disassembly of members in order to prevent lateral buckling and accidental torsion. The reinforcement device includes an accommodation unit for surrounding a steel member, first and second cover units connected to the accommodation unit and formed to cover the steel member, and a fixation member for fixing the first and second cover units.

6 Claims, 6 Drawing Sheets

REINFORCEMENT DEVICE FOR LATERAL BUCKLING STRESS AND METHOD OF ENGAGING REINFORCEMENT DEVICE

BACKGROUND OF THE INVENTION

1. Field of the Invention

The present invention relates to a reinforcement device for a lateral buckling stress installed on an angle-type steel member so as to be attachable and detachable therefrom without power-off of a power line tower, preparation and disassembly of members in order to prevent lateral buckling and accidental torsion.

2. Description of the Related Art

Generally, a power line tower is configured as a truss structure. The truss structure can withstand external forces by using the tension and compressive force of steel members by connecting the steel members to each other in a triangular shape, and can be lighter and stronger. Thus, the truss structure is effective against an earthquake. An angle-type steel member is used as steel member used in the power line tower having the truss structure, and is used as a brace for withstanding a lateral force used in a steel structure.

However, the angle-type steel member is vulnerable to lateral buckling and accidental torsion. When one angle-type steel member of any structure begins to buckle due to accidental typhoon or gust, other angle-type steel members collapse consecutively. Thus, the management of the angle-type steel member is very important in such a way that the angle-type steel member may not be bent and distorted.

That is, as shown in FIG. 1, when the angle-type steel member ('L' type steel main post member) has a relatively great length compared to a width of a cross-section, compressive load acts on both ends of the angle-type steel member, and thus lateral buckling by which a post buckles suddenly occurs when the compressive load reaches a predetermined intensity.

In order to reinforce a lateral buckling stress, a member having a great cross-section is replaced with the angle-type steel member with a weak lateral buckling stress, or backplates are bonded to the angle-type steel member. However, in these methods, preparation operations such as power-off of a power line tower, installment of a bypass reinforcement member and disassembly of members are required. In addition, lots of time and costs are incurred for detours of power lines, drawings and preparation when the angle-type steel member with a weak lateral buckling stress is used.

SUMMARY OF THE INVENTION

The present invention provides a reinforcement device for a lateral buckling stress installed on an angle-type steel member so as to be attachable and detachable therefrom without power-off of a power line tower, preparation and disassembly of members in order to prevent lateral buckling and accidental torsion.

According to an aspect of the present invention, there is provided a reinforcement device for a lateral buckling stress includes an accommodation unit for surrounding a steel member, first and second cover units connected to the accommodation unit and formed to cover the steel member, and a fixation member for fixing the first and second cover units.

The steel member may be an angle-type steel member.

The accommodation unit may include a first accommodation unit for surrounding a first side of the angle-type steel member, and a second accommodation unit perpendicular to the first accommodation unit and for surrounding a second side of the angle-type steel member.

The first cover unit may include a first hinge ring and a first hinge ring connection pin which are formed to be connected to a side of the first accommodation unit, a first bent portion bent to cover a first side end of the angle-type steel member, and a second bent portion of which portion facing the second cover unit is bent.

The first hinge ring and the first hinge ring connection pin may allow the first cover unit to move up and down.

The second cover unit may include a second hinge ring and a second hinge ring connection pin which are formed to be connected to a side of the second accommodation unit, a third bent portion bent to cover a second side end of the angle-type steel member, and a fourth bent portion of which portion facing the first cover unit is bent.

The second hinge ring and the second hinge ring connection pin may allow the second cover unit to move up and down.

The fixation member may include a plurality of bolts for fixing the first and second cover units so as to face each other.

The first and second cover units may be fixed by inserting the plurality of bolts through a plurality of holes formed in portions of the first and second cover units, wherein the portions face each other.

According to another aspect of the present invention, there is provided a method of engaging a reinforcement device for a lateral buckling stress includes accommodating an angle-type steel member in a member accommodation unit so as to be surrounded by the member accommodation unit, covering the angle-type steel member accommodated in the member accommodation unit by first and second cover units, and fixing the first and second cover units so as to face each other.

The fixing of the first and second cover units may be performed by inserting a plurality of bolts through a plurality of holes formed in portions of the first and second cover units, wherein the portions face each other.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, the present invention will be described in detail by explaining exemplary embodiments of thereof with reference to the attached drawings.

Figure 1:
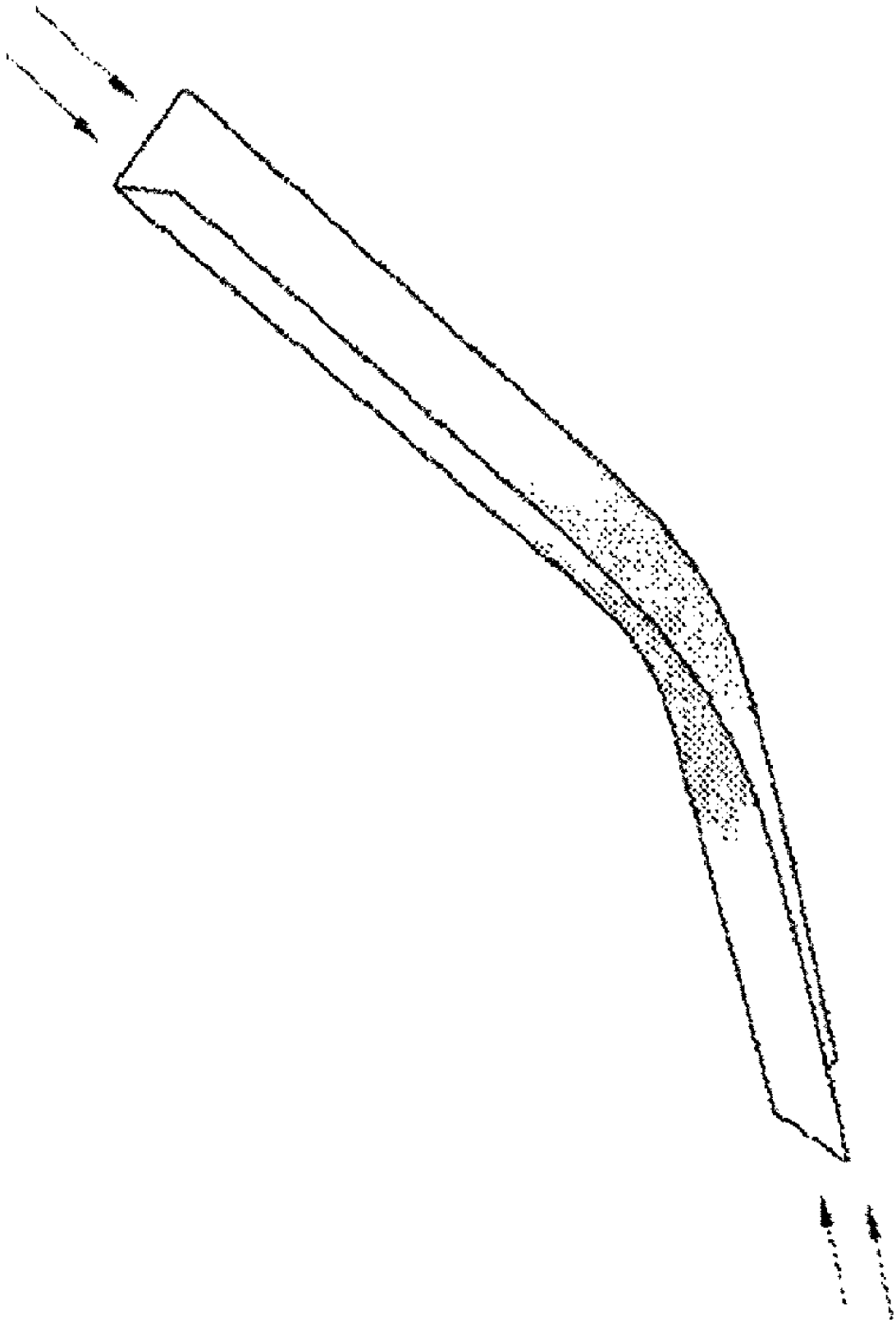
FIG. 1 PRIOR ART
FIG. 1 is a diagram for explaining lateral buckling occurring in a conventional angle-type steel member used in a power line tower or a steel structure.
Figure 2:
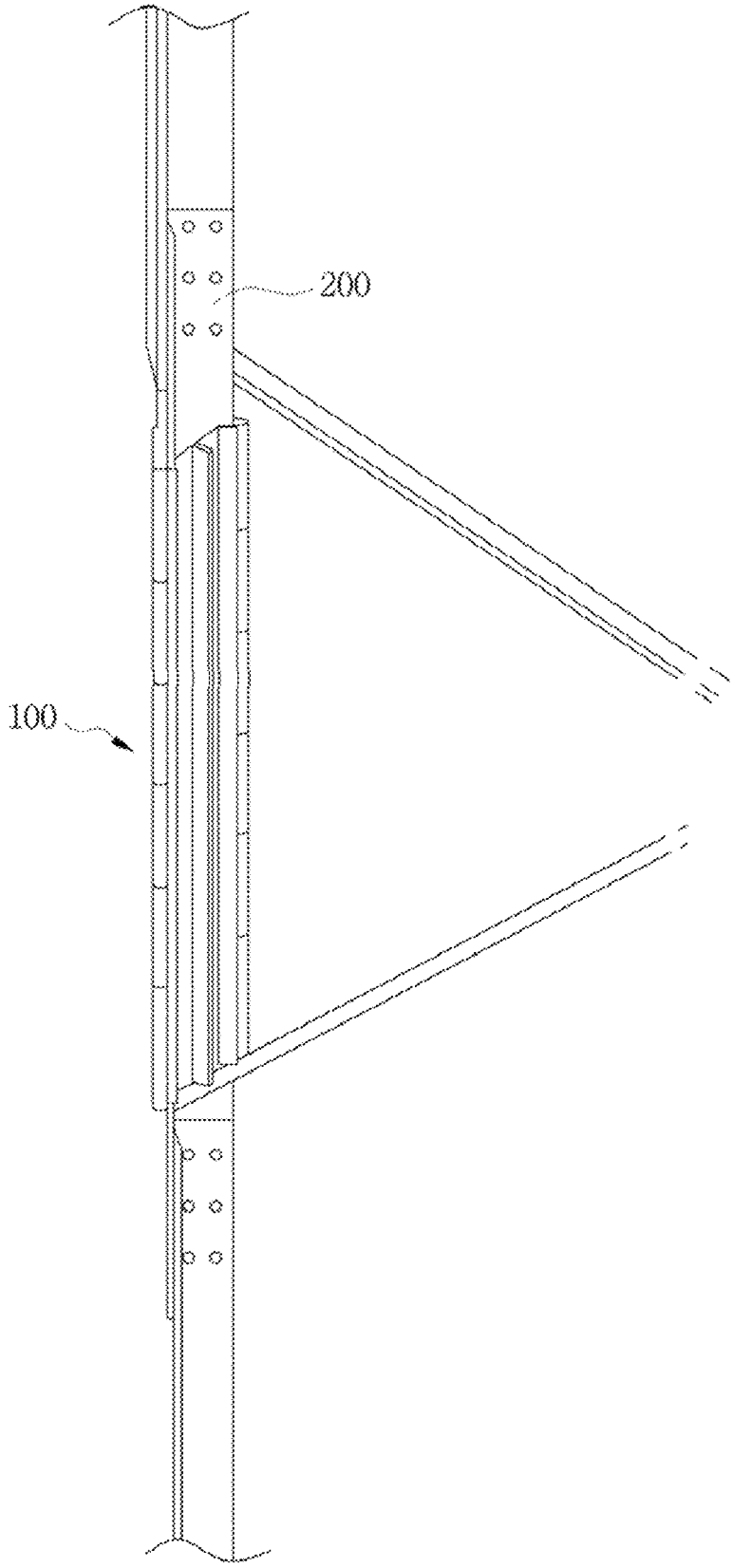
FIG. 2 is a perspective view of a case where a reinforcement device for a lateral buckling stress is installed to an angle-type steel member, according to an embodiment of the present invention.
Figure 3:
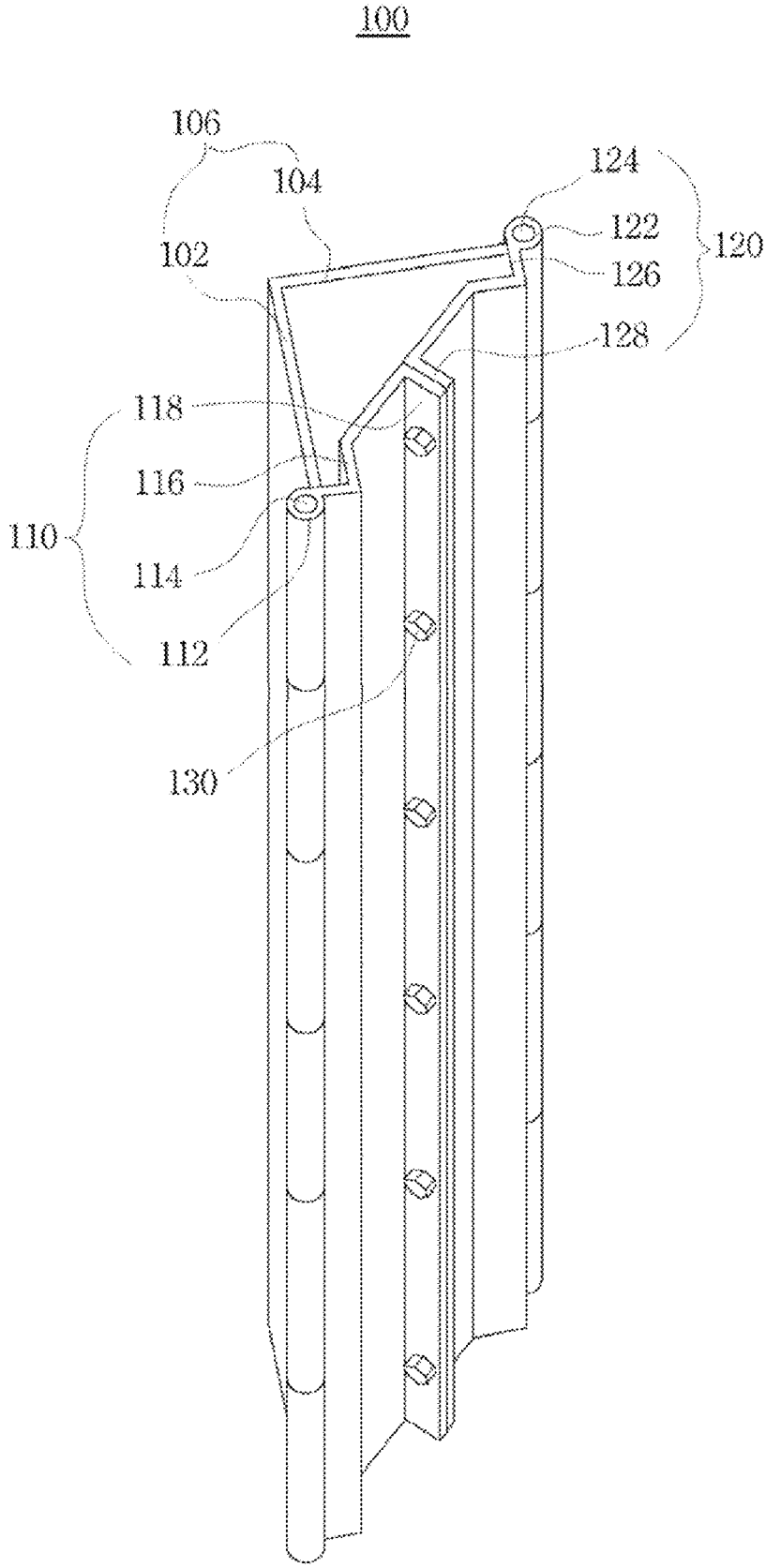
FIG. 3 is a perspective view for explaining the reinforcement device of FIG. 2 in more detail, according to an embodiment of the present invention.

FIG. 2 is a perspective view of a case where a reinforcement device 100 for a lateral buckling stress is installed to an angle-type steel member 200, according to an embodiment of the present invention. FIG. 3 is a perspective view for explaining the reinforcement device 100 of FIG. 2 in more detail, according to an embodiment of the present invention.

Generally, a power line tower is configured as a truss structure. The truss structure can withstand external forces by using the tension and compressive force of steel members by connecting the steel members to each other in a triangular shape, and can be lighter and stronger. Thus, the truss structure is effective against an earthquake. According to the present embodiment, the angle-type steel member 200 is used as a steel member used in a power line tower having a truss structure, and the angle-type steel member 200 is used as a brace for withstanding a lateral force in a steel structure. In this case, the reinforcement device 100 that is attachable and detachable is used to prevent lateral buckling and accidental torsion. To achieve this, the reinforcement device 100 includes a member accommodation unit 106 for surrounding the angle-type steel member 200, first and second cover units 110 and 120 that are connected to the member accommodation unit 106 and are formed to cover the member accommodation unit 106, and a fixation member 130 for fixing the first and second cover units 110 and 120.

The member accommodation unit 106 includes the first and second accommodation units 102 and 104 for surrounding the angle-type steel member 200, as shown in FIG. 3. The first and second accommodation units 102 and 104 are perpendicularly formed to each other. That is, the first accommodation unit 102 surrounds a first side of the angle-type steel member 200, and the second accommodation unit 104 surrounds a second side of the angle-type steel member 200. That is, the first accommodation unit 102 and the second accommodation unit 104 are formed to have an 'L' or inverted 'L' shape.

The first cover unit 110 is connected to a side of the first accommodation unit 102, and is formed to cover a portion of the angle-type steel member 200. The second cover unit 120 is connected to a side of the second accommodation unit 104, and is formed to cover a portion of the angle-type steel member 200.

In detail, the first cover unit 110 includes a first hinge ring 112 and a first hinge ring connection pin 114 in order to connect a side of the first accommodation unit 102 to the first cover unit 110. The first cover unit 110 may be easily moved up and down by connecting the first cover unit 110 and the first accommodation unit 102 by using the first hinge ring 112 and the first hinge ring connection pin 114.

In addition, the first cover unit 110 includes a first bent portion 116 that is adjacent to the first hinge ring 112 and is bent to cover a first side end of the angle-type steel member 200, and a second bent portion 118 of which portion facing the second cover unit 120 is bent. Since the first bent portion 116 is bent to cover the first side end of the angle-type steel member 200, the first bent portion 116 is formed to have an 'L' or inverted 'L' shape and to have an appropriate dimension greater than or equal to the thickness of the angle-type steel member 200.

The second cover unit 120 includes a second hinge ring 122 and a second hinge ring connection pin 124 in order to connect a side of the second accommodation unit 104 to the second cover unit 120. The second cover unit 120 may be easily moved up and down by connecting the second cover unit 120 and the second accommodation unit 104 by using the second hinge ring 122 and the second hinge ring connection pin 124.

In addition, the second cover unit 120 includes a third bent portion 126 that is adjacent to the second hinge ring 122 and is bent to cover a second side end of the angle-type steel member 200, and a fourth bent portion 128 of which portion facing the second bent portion 118 of the first cover unit 110 is bent. Since the third bent portion 126 is bent to cover the second side end of the angle-type steel member 200, the third bent portion 126 is formed to have an 'L' or inverted 'L' shape and to have an appropriate dimension greater than or equal to the thickness of the angle-type steel member 200.

The fixation member 130 includes a plurality of connection bolts for fixing the first and second cover units 110 and 120 so that the first and second cover units 110 and 120 face each other. A plurality of first holes 132 are formed in the second bent portion 118 of the first cover unit 110. A plurality of second holes 134 corresponding to the first holes 132 are formed in the fourth portion 128 of the second cover unit 120. Thus, the fixation member 130 is inserted through the first holes 132 of the second bent portion 118 of the first cover unit 110 and the second holes 134 of the fourth bent portion 128 of the second cover unit 120, wherein the first holes 132 and the second holes 134 face each other, and thus the second bent 118 and the forth bent portion 128 are fixed to face each other.

Figure 4A:
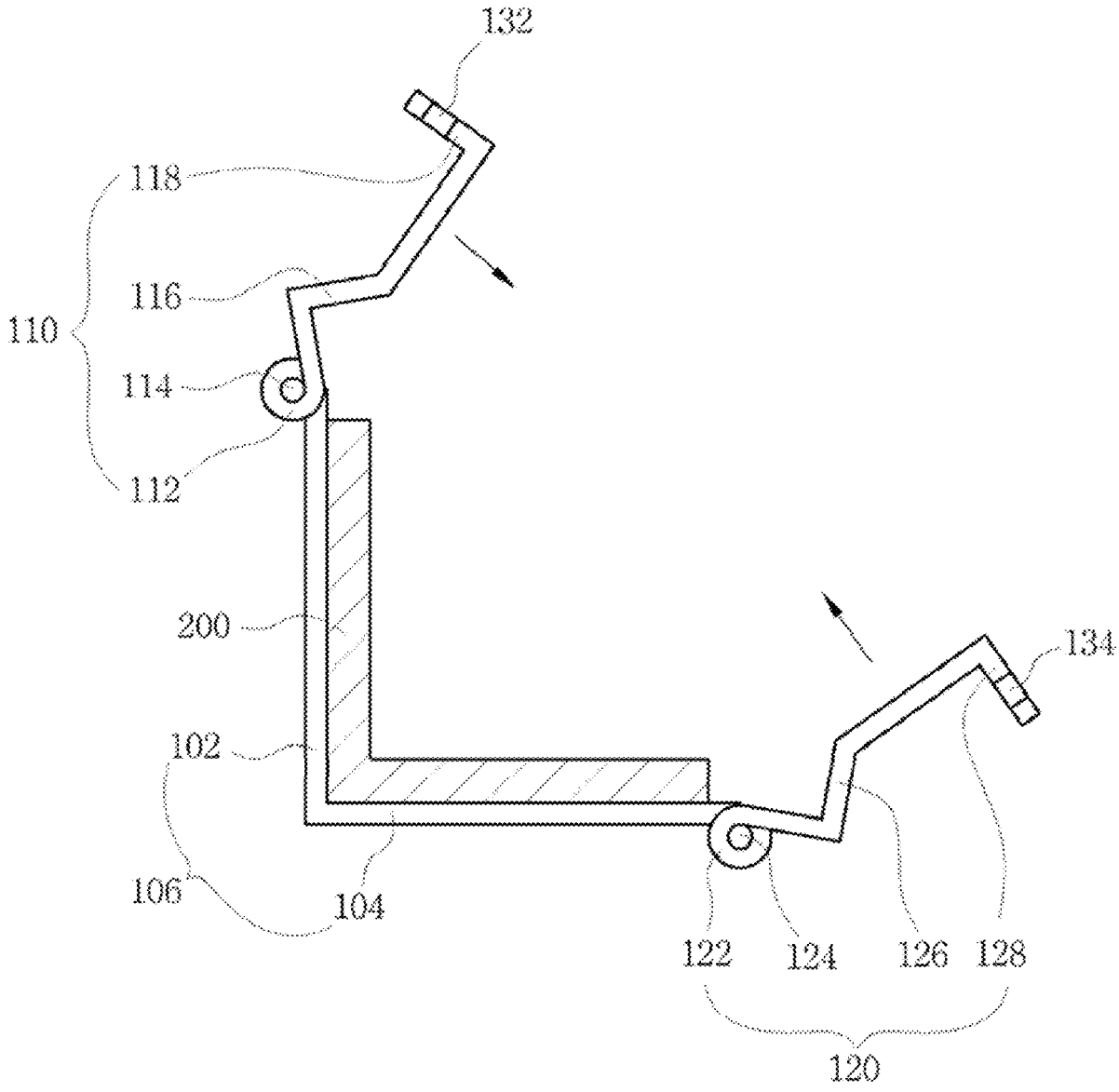
FIGS. 4A and 4B are cross-sectional views for explaining a method of engaging a reinforcement device with an angle-type steel member, according to an embodiment of the present invention.
Figure 4B:
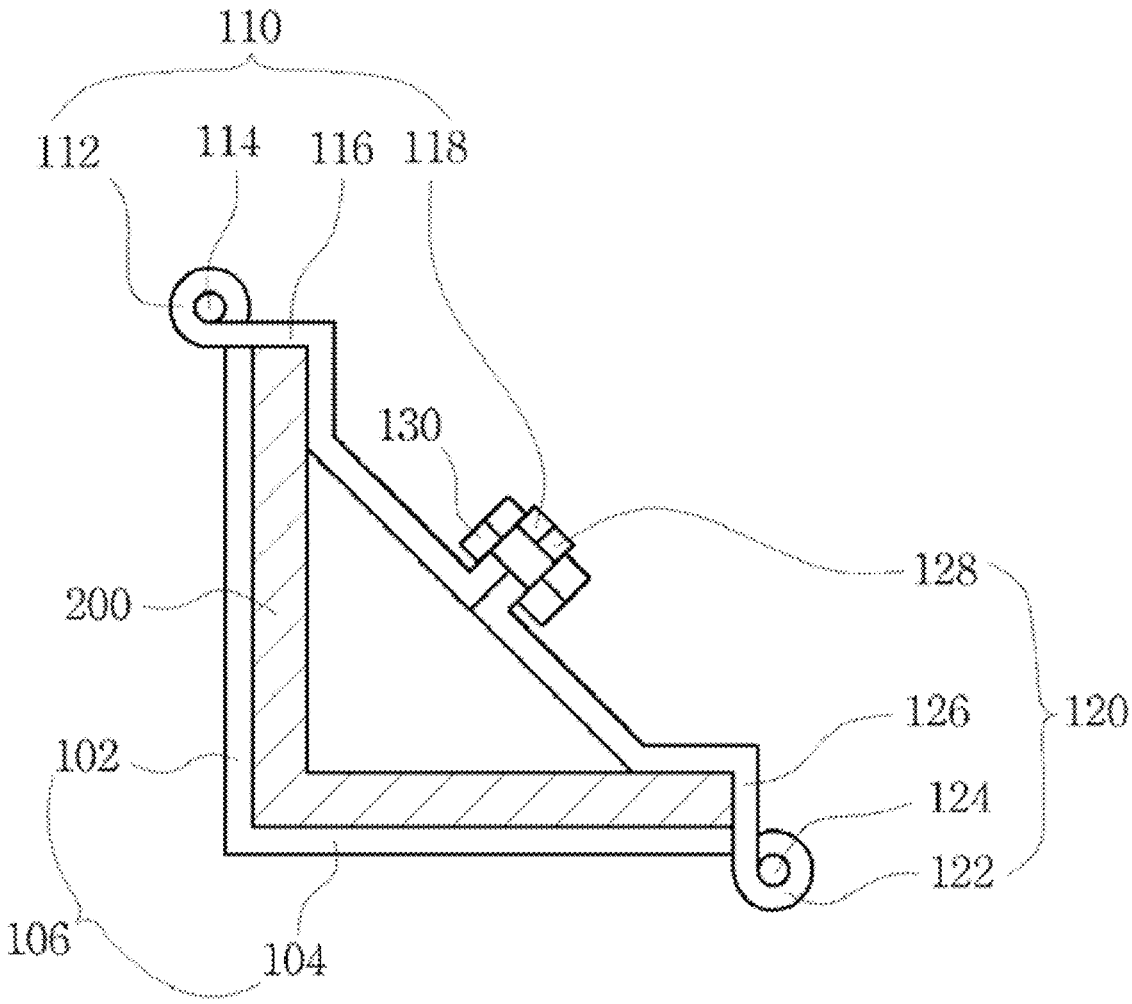

FIGS. 4A and 4B are cross-sectional views for explaining a method of engaging the reinforcement device 100 with the angle-type steel member 200, according to an embodiment of the present invention.

According to the present embodiment, the method of engaging the reinforcement device 100 with the angle-type steel member 200 includes accommodating the angle-type steel member 200 in the member accommodation unit 106 so as to be surrounded by the member accommodation unit 106, covering the angle-type steel member 200 accommodated in the member accommodation unit 106 by the first and second cover units 110 and 120, and fixing the first and second cover units 110 and 120 so as to face each other.

First, as shown in FIG. 4A, the angle-type steel member 200 is accommodated in the member accommodation unit 106 so as to be surrounded by the member accommodation unit 106. In this case, the first and second covers 110 and 120 are opened in such a way that the angle-type steel member 200 is accommodated in the member accommodation unit 106. As shown in FIG. 4B, after the angle-type steel member 200 is accommodated in the member accommodation unit 106, the first and second cover units 110 and 120 are closed towards the angle-type steel member 200. That is, the first and second cover units 110 and 120 are closed in such a way that the second bent portion 118 of the first cover unit 110 and the fourth bent portion 128 of the second cover unit 120 face each other. Then, the first and second cover units 110 and 120 are fixed by inserting a plurality of connection bolts through the first holes 132 formed in the second bent portion 118 of the first cover unit 110 and the fourth bent portion 128 of the second cover unit 120.

Figure 5:
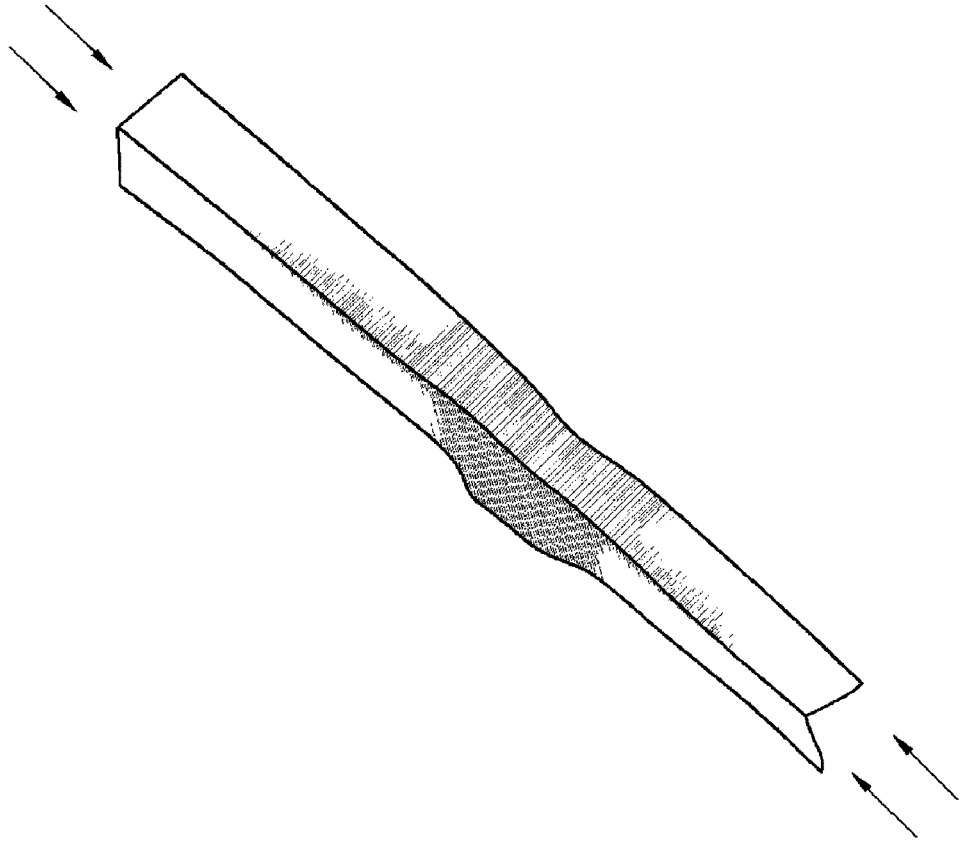
FIG. 5 is a diagram for explaining a case where a lateral buckling stress is reinforced by a reinforcement device, according to an embodiment of the present invention.

A lateral buckling stress is reinforced by reinforcing the angle-type steel member 200 by using the reinforcement device 100, thereby preventing buckling, as shown in FIG. 5. In addition, in order to reinforce a lateral buckling stress, the reinforcement device 100 may be simply installed on the angle-type steel member 200 to be attachable and detachable therefrom without preparation operations such as power-off of a power line tower, installment of a bypass reinforcement member and disassembly of members.

Figure 6:
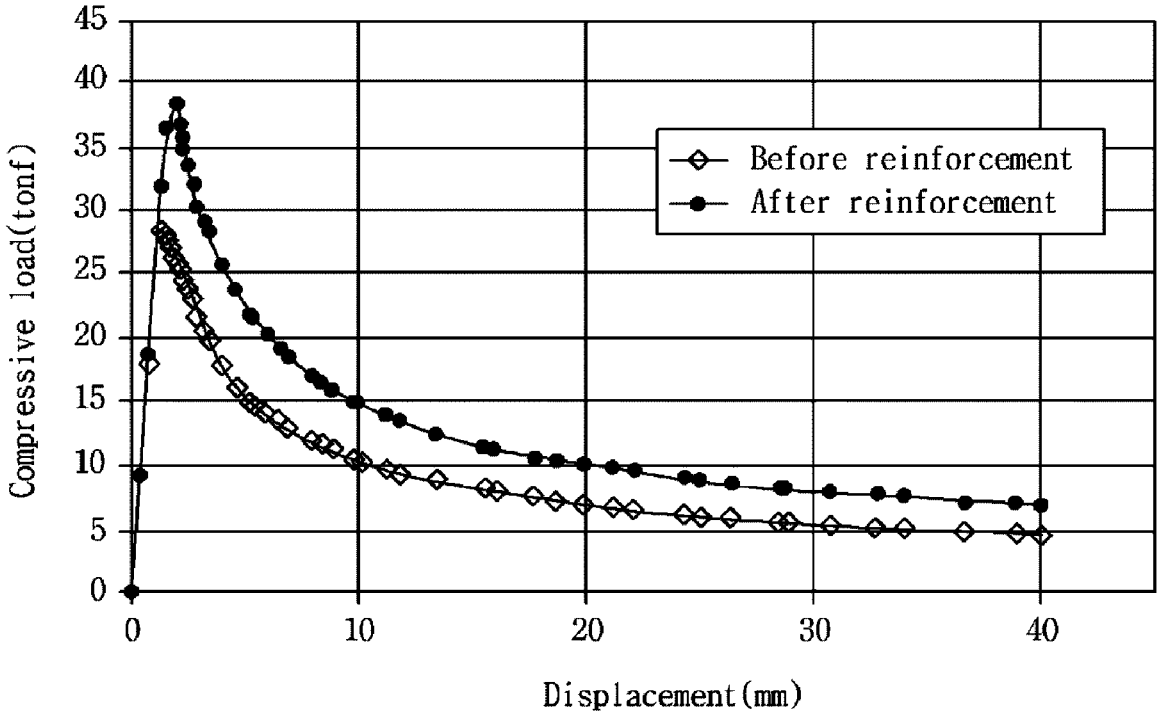
FIG. 6 is a graph for explaining a case where compressive load increases by a reinforcement device, according to an embodiment of the present invention.

FIG. 6 is a graph for explaining a case where compressive load increases by a reinforcement device, according to an embodiment of the present invention. Accordingly, a reinforcement device for a lateral buckling stress according to the present invention is installed on an angle-type steel member so as to be attachable and detachable therefrom, thereby increasing the lateral buckling stress of the angle-type steel member. In this case, power-off of a power line tower, a process of bolt holes for installing a bypass reinforcement member, and disassembly of members are not required.

In addition, a structure or power line using the angle-type steel member may stably operate by immediately reinforcing a lateral buckling stress for a short period of time without any preparation and disassembly of members by installing the reinforcement device on the angle-type steel member so as to be attachable and detachable therefrom.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A reinforcement device for a lateral buckling stress, the reinforcement device comprising:

an accommodation unit for surrounding a steel member;

first and second cover units connected to the accommodation unit and formed to cover the steel member; and a fixation member for fixing the first and second cover units, wherein the accommodation unit comprises:

a first accommodation unit for surrounding a first side of the steel member; and a second accommodation unit perpendicular to the first accommodation unit and for surrounding a second side of the steel member, and wherein the first cover unit comprises:

a first hinge ring and a first hinge ring connection pin which are formed to be connected to a side of the first accommodation unit;

a first bent portion bent to cover a first side end of the steel member; and a second bent portion of which portion facing the second cover unit is bent.

2. The reinforcement device of claim 1, wherein the first hinge ring and the first hinge ring connection pin allow the first cover unit to move up and down.

3. The reinforcement device of claim 1, wherein the second cover unit comprises:

a second hinge ring and a second hinge ring connection pin which are formed to be connected to a side of the second accommodation unit;

a third bent portion bent to cover a second side end of the angle type steel member; and a fourth bent portion of which portion facing the first cover unit is bent.

4. The reinforcement device of claim 3, wherein the second hinge ring and the second hinge ring connection pin allow the second cover unit to move up and down.

5. The reinforcement device of claim 1, wherein the fixation member comprises a plurality of bolts for fixing the first and second cover units so as to face each other.

6. The reinforcement device of claim 5, wherein the first and second cover units are fixed by inserting the plurality of bolts through a plurality of holes formed in portions of the first and second cover units, wherein the portions face each other.

* * * * *